United States Patent [19]

Marconi

[11] 4,143,569

[45] Mar. 13, 1979

[54] DIE HOLDER FOR PUNCH PRESSES

[76] Inventor: Joseph Marconi, 428 S. Jensen Rd., Vestal, N.Y. 13850

[21] Appl. No.: 817,149

[22] Filed: Jul. 20, 1977

Related U.S. Application Data

[63] Continuation-in-part of Ser. No. 660,271, Feb. 23, 1976, Pat. No. 4,085,639.

[51] Int. Cl.[2] ..... B26F 1/14

[52] U.S. Cl. ..... 83/160; 83/146; 83/690; 83/698

[58] Field of Search ..... 83/160, 133, 685, 688, 83/690, 698, 146

[56] References Cited

U.S. PATENT DOCUMENTS

| | | | |
|---|---|---|---|
| 2,019,791 | 11/1935 | Nelson | 83/160 X |
| 2,568,152 | 9/1951 | Hermann | 83/690 |
| 3,673,902 | 7/1972 | Strobel | 83/685 |
| 3,777,601 | 12/1973 | Strandell | 83/160 |

*Primary Examiner*—Donald R. Schran

*Attorney, Agent, or Firm*—Frederick E. Bartholy

[57] ABSTRACT

A die holder for punch presses for placement in a die set is described. It consists of a die element retained by a frame member supported on pads secured to a die block. A sliding support between the die element and the die block is provided, reinforcing the die upon impact of the punch. The frame member is undercut, permitting saving of material and distribution of mass at points of maximum stress.

3 Claims, 6 Drawing Figures

DIE HOLDER FOR PUNCH PRESSES

This is a continuation-in-part of my pending application, Ser. No. 660,271 filed Feb. 23, 1976, now U.S. Pat. No. 4,085,639, issued Apr. 25, 1978.

DESCRIPTION OF THE PRIOR ART

In the art of metal stamping utilizing punch presses, use is made of an assembly which in trade parlance is known as a "die set". The purpose of a die set is to contain and properly support tooling and to assure alignment of the tooling at the area of work. The die set typically consists of a steel top plate and a steel bottom plate aligned with one another by means of guide pins and bushings, permitting vertical movement of the top plate relative to the bottom plate but preventing relative lateral movement therebetween. The top plate is affixed to a press ram and the bottom plate is affixed to a press bed for movement of the top plate toward the bottom plate to thus perform work on a workpiece placed therebetween.

An illustration of a "die set" is seen in U.S. Pat. No. 3,782,166.

Various mechanisms for using blanking dies and ejecting the cut blanks have been described in the prior art. U.S. Pat. Nos. 2,325,290; 2,444,946; 3,043,176; 3,656,380; and 3,777,601 may serve as examples. Such mechanisms have the purpose of stamping sheet metals into pieces, generally referred to as part blanks, and to clear the blanks from the punch press and to deposit them at a remote location.

In The present invention, the holder of the die, for use in connection with a standard die set, is of particular interest.

SUMMARY OF THE INVENTION

It is the primary object of the invention to improve the construction of dies and, in particular, the holders thereof, so that the latter may become a coactive functional assembly.

It is a salient feature of the invention that relatively thin die plates may be used in place of conventional massive structures, resulting in savings of material and production costs.

It is a particular advantage of the invention that the die holder herein described not only lends a solid support for the die during the blanking cycle, but is also easily adjustable for compensation of wear after extensive use.

Other objects, features and advantages will be apparent from the following description of the invention, pointed out in particularity in the appended claims, and taken in connection with the accompanying drawings, in which:

DESCRIPTION OF THE PREFERRED EMBODIMENT

Prior to a detailed consideration of the drawings, let us briefly examine the state of the art in general.

The purpose of a metal cutting die is to pierce or blank a regular or irregular contour of sheet metal in one powerful stamping impact of a punch. Obviously a die must be a solid block of hardened steel in order to withstand the impact of the punch. Depending upon the size of the blank to be cut and the thickness of material from which it is to be cut, conventional dies are generally made of hardened tool steel of considerable thickness. The solid metal portion, namely, the thickness, governs the strength of the die to withstand the enormous pressure to which it is subjected upon impact of the punch. Large blocks of steel for each die represent not only considerable use of material, but labor costs as well. Dies are generally placed on the lower plate of a die set and fastened to it by various means.

In accordance with the teachings of my U.S. Pat. No. 3,965,784, such dies may be reduced to one third or more of the normal thickness. This is achieved by the concept of utilizing a holder which, aside from being a support, is also operationally functional in the blanking process. In short, a die plate of relatively thin cross section is placed in a holder which provides space beneath the die. Support means in the form of a sliding block or plate is so arranged as to move into this space and under the die during blanking operation.

Holders for such thin die plates require special construction in order to provide accurate seating, easy access, as well as compensation for wear.

The holder in accordance with this invention fulfills the above requirements. It is simple in construction, providing firm support for the die. The component elements thereof may easily be assembled.

Figure 1:
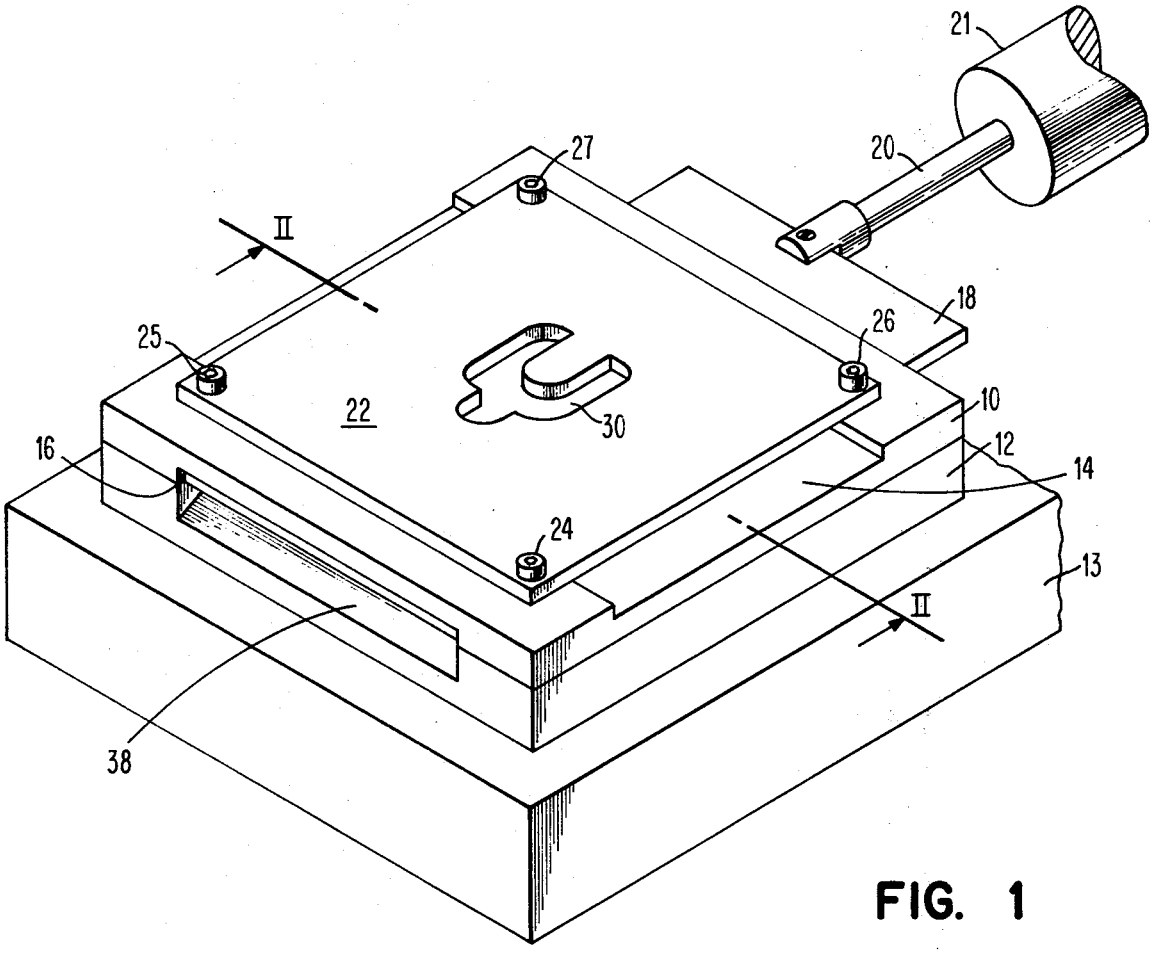
FIG. 1 is a perspective view of the die holder with its operational elements assembled and placed on the bottom plate of a die set.

Referring to the figures, as seen in FIG. 1, the die holder comprises an assembly of several operational elements of which the important one — in accordance with the invention — is the die retaining frame member 10 which rests on a die block 12. The latter is shown being placed on the bottom plate 13 of a die set. Frame member 10 is of such configuration as to provide a channel 14 for feeding of the workpiece from which the blanks are to be punched, and a channel 16 for the reciprocating die support plate 18.

By way of example, an actuating rod 20 and piston member 21 are shown attached to the support plate 18 merely to indicate that the latter slides within the channel 16 upon a force exerted on the rod 20 to move in the direction axial thereto.

Above the frame member 10 which, as will be seen in continuing with the description, surrounds the die, per se, is the stripper plate 22 which is mounted by means of bolts 24, 25, 26, and 27 to the die block 12 in order to form a solid unitary structure.

A cutout 30, of a particular shape, merely for the sake of illustration, is shown in the stripper plate 22. This is the form which will be punched out of the workpiece by virtue of the die which underlies the stripper plate and is not seen in this view.

Figure 2:
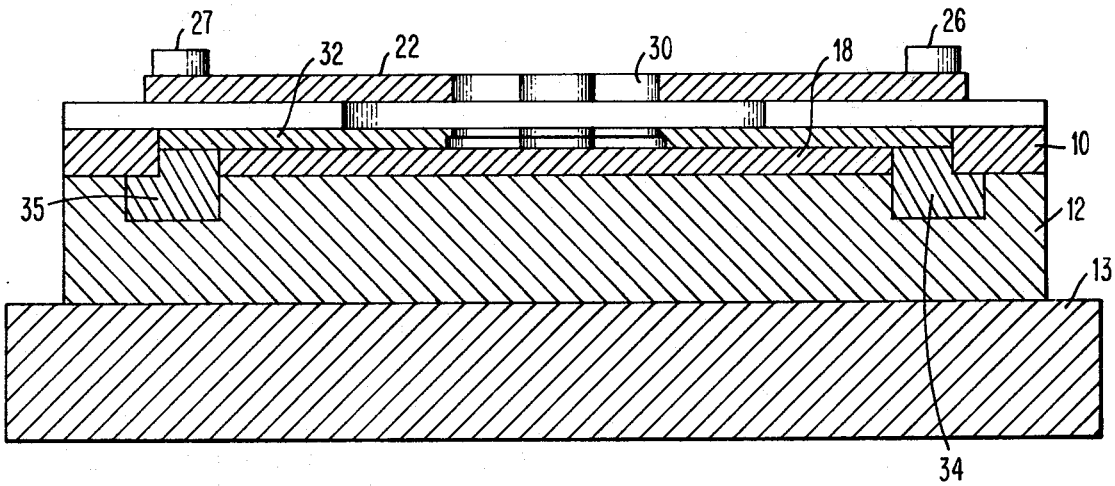
FIG. 2 is a sectional view of the die holder taken along line II—II of FIG. 1.

Referring to FIG. 2, the sectional view illustrates the assembly of component elements. The die plate 32 rests on support pads 34 and 35 which are mounted in the die block 12. As will be seen, the pads 34 and 35 have an important function in the assembly in that these are, in fact, inserts easily removable in order to determine the vertical seating of the die plate 32. It is also seen in this figure that the die support plate 18 underlies the relatively thin die plate 32 in order to reinforce it during the blanking operation.

Figure 3:
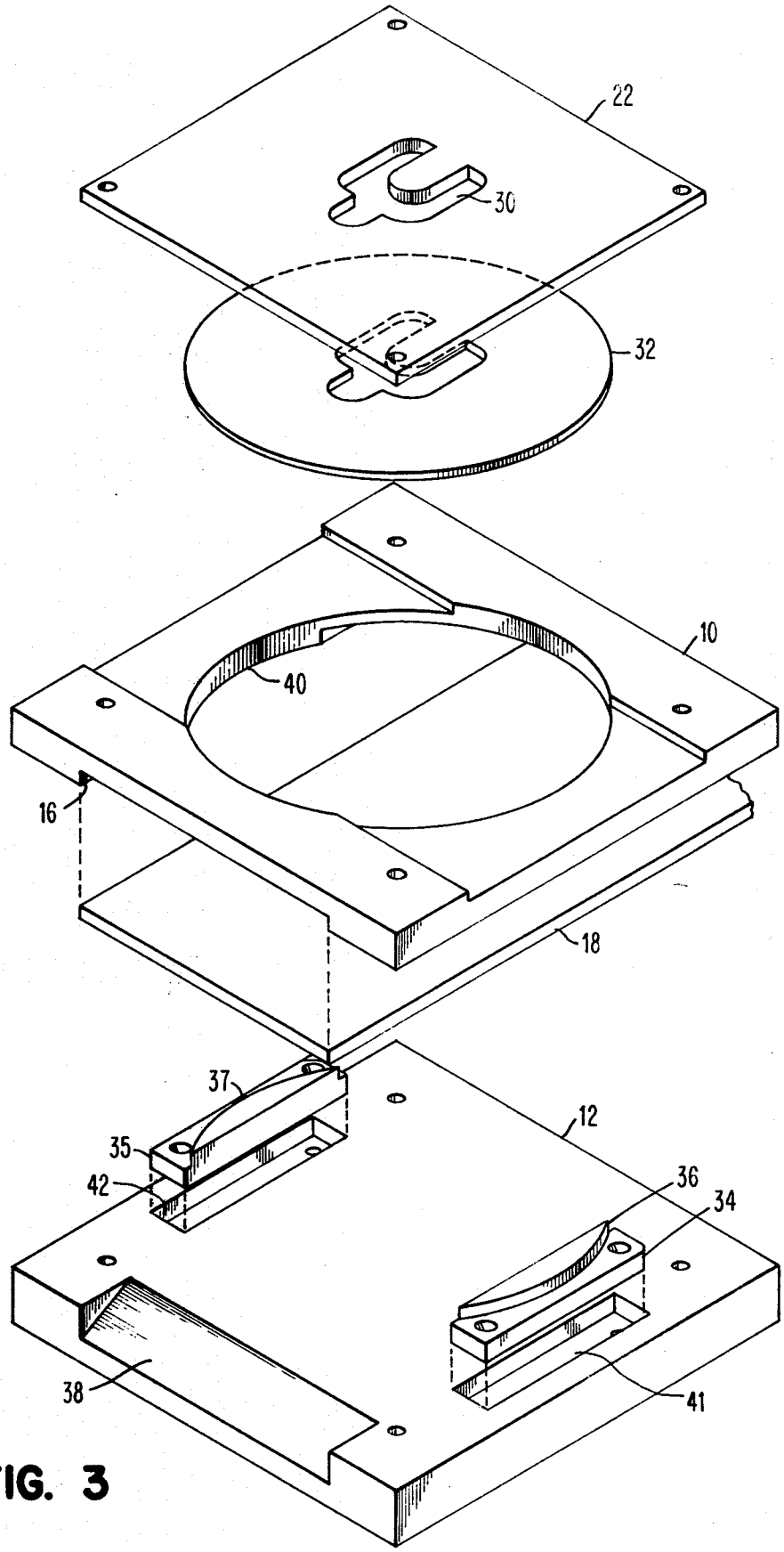
FIG. 3 is an exploded view of the holder shown in FIG. 1, illustrating the relationship of the component elements thereof.

A more illustrative view of the die holder assembly is seen in FIG. 3. Identical components bear the same reference characters.

Let us consider first the die block 12. The front portion has a slanting surface 38 over which the part blanks drop out after being ejected by the movement of the sliding support plate 18.

It is seen that the frame member 10 is a solid block having an inner wall 40 which defines a circular opening of such diameter which accepts the die plate 32 so that, when assembled, it may rest on the segmental top portions 36 and 37 of the support pads 34 and 35. The die block 12 has cutouts 41 and 42 which accept the pads 34 and 35, respectively. The latter, in fact, are inserts which may easily be removed and reinserted as the case may be. For the sake of simplifying the illustration, the retaining bolts for the inserts are omitted and only the holes for such bolts are indicated. It is to be understood that these inserts are firmly bolted down to become part of the die block 12. When the components are assembled as shown in FIGS. 1 and 2, the die plate 32 is supported solely by the segmental portions 36 and 37 of the pads 34 and 35.

The frame member 10 which surrounds the die plate 32 plays an important part in stabilizing the location thereof; whereas the pads 34 and 35 perform the function of a support for the blanking operation. Mention should be made also that in this connection the sliding plate 18 plays a very important part. As a matter of fact, it permits the use of a relatively thin die plate. The illustration in FIG. 3, while not drawn to scale, nonetheless intends to show the relative mass of the component elements of the die holder in accordance with the invention.

It is to be observed that the frame member 10 is undercut. The front and rear portions are thicker whereas, in the middle plane, the thickness is effectively reduced to that of the die plate 32. The mass is thus distributed where needed to form a solid structure. The channel 16 which accepts the sliding plate 18 is part of the undercut.

The support pads 34 and 35 represent considerable improvement inasmuch as they can easily be removed and the segmental portions 36 and 37 ground when needed for adjustment of the seating of the die plate 32. New pads of the type shown may easily be made when necessary without in any way altering the die holder, per se. The entire assembly requires only four bolts 24, 25, 26, and 27 (FIG. 1) in order to secure the component elements into a unitary structure for a die holder.

In FIGS. 1 and 2, the holder is shown placed on the bottom plate 13 of a die set. It is to be understood that the holder must be firmly secured to the die set. This may be effected by various means which form no part of the invention. Consequently, such means are not illustrated. In one form, the die block 12 may be bolted to the bottom plate of the die set. The latter may have laterally extending ears whereby it is secured to the press bed. Several other ways used in the metal stamping art may be employed. Suffice it to say that in use in combination with a die set the holder constructed in accordance with the invention is firmly attached to the bottom plate 13 of a die set.

Figure 4:
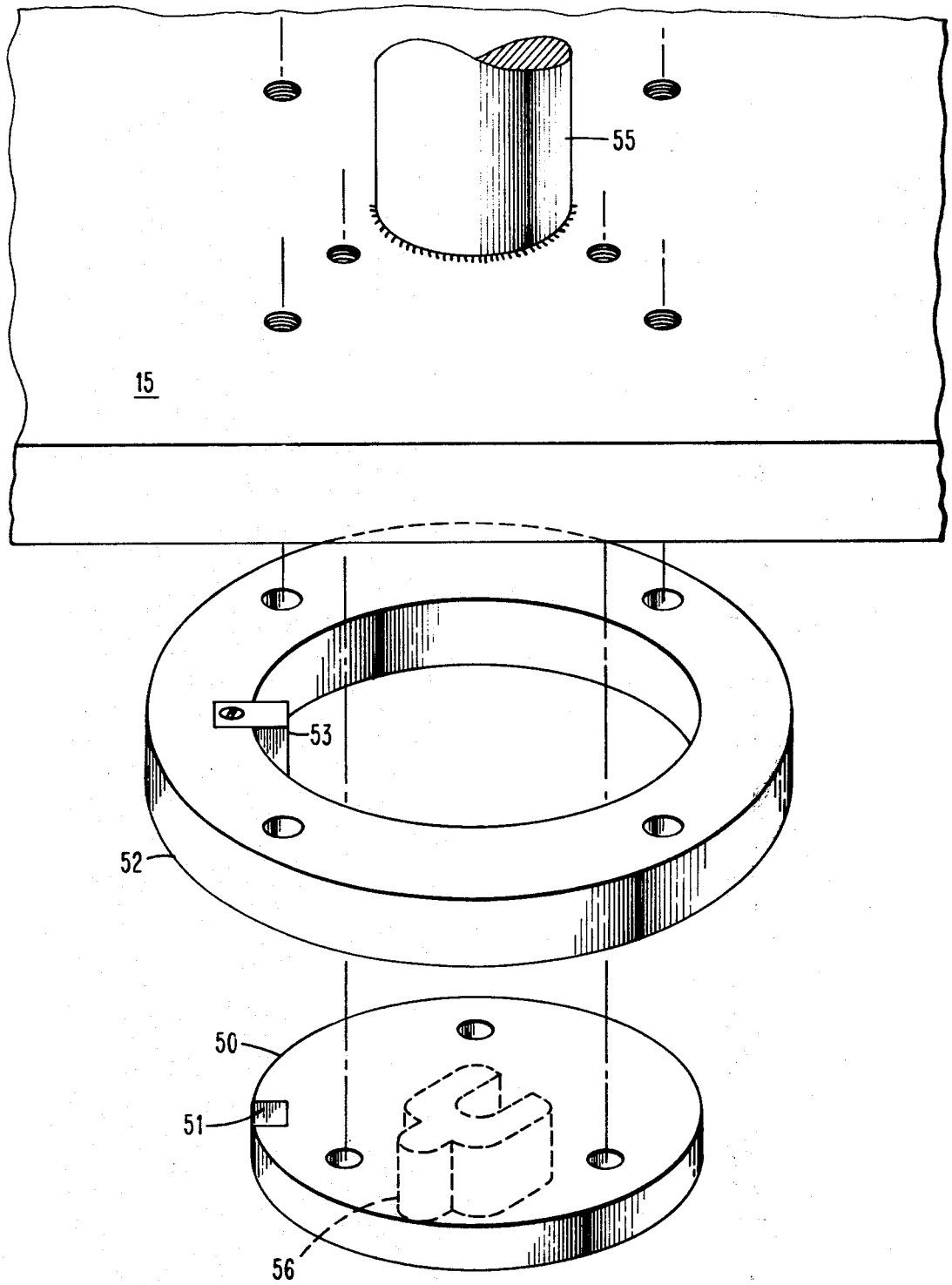
FIG. 4 is an exploded view, illustrating the mounting of the punch to the top plate of a die set.
Figure 5:
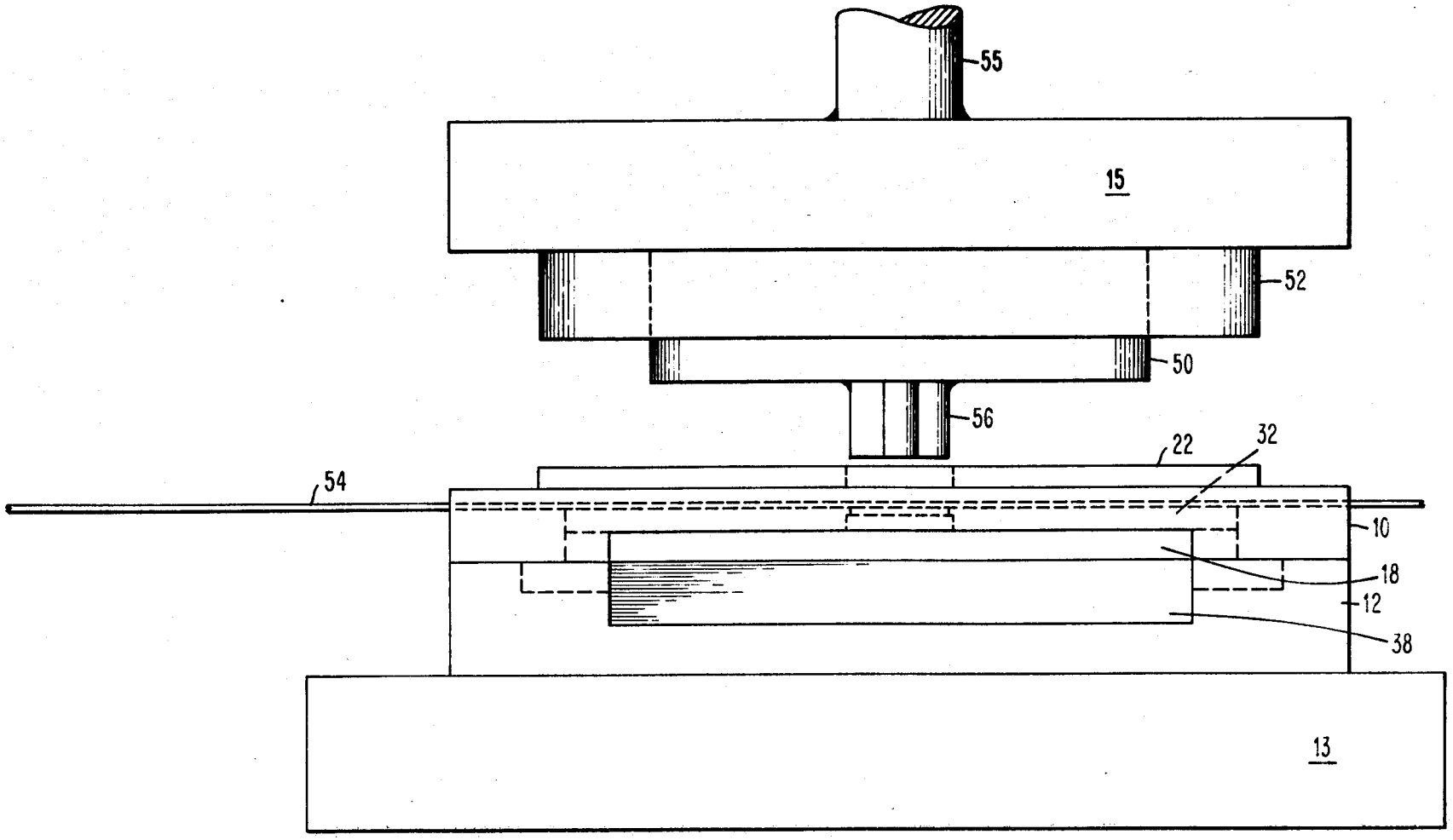
FIG. 5 is a front elevational view of the die holder mounted in a die set together with the punch assembly ready for the blanking operation.
Figure 6:
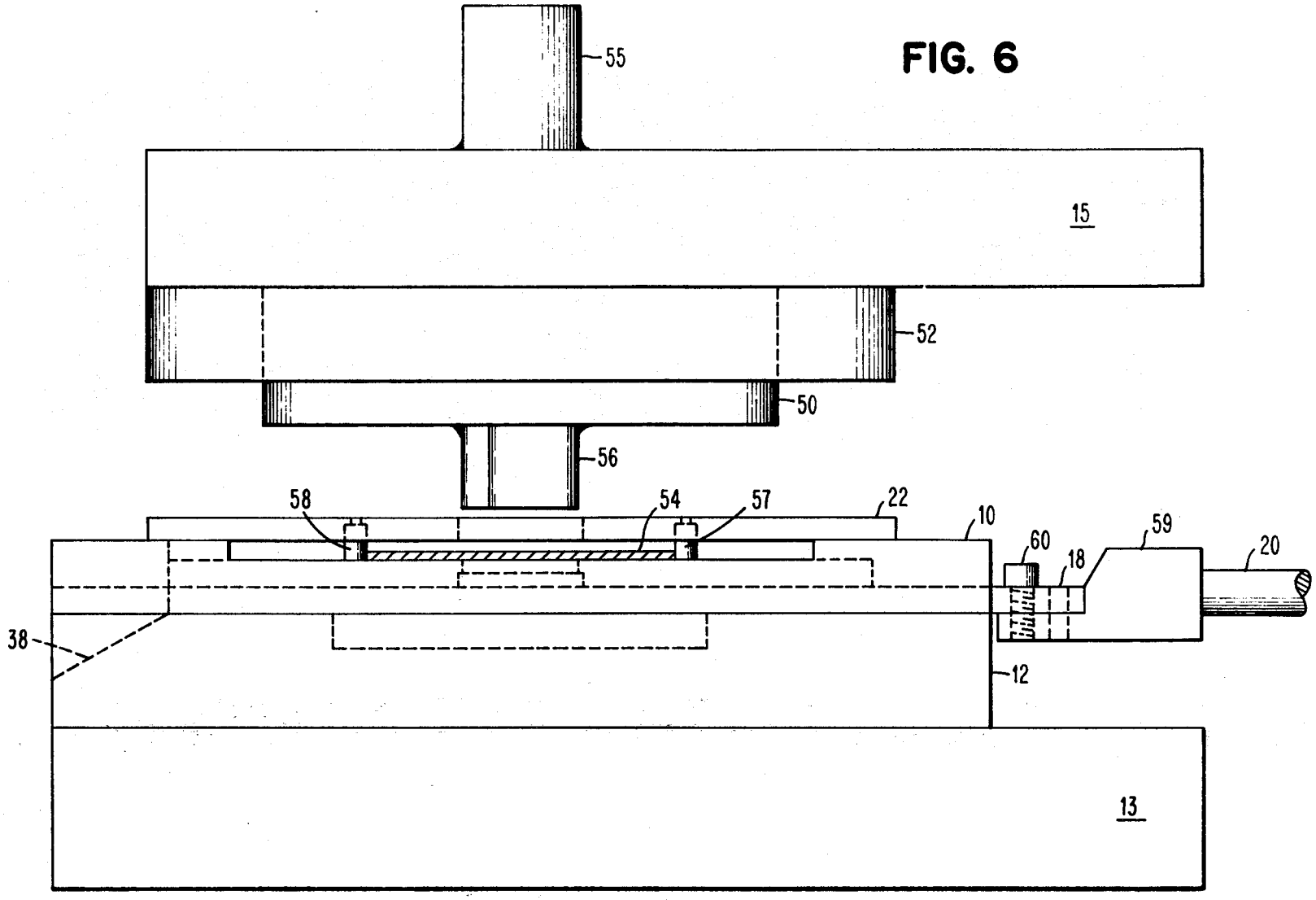
FIG. 6 is a side elevational view of the assembly shown in FIG. 5.

To give a general illustration of its use, reference should be had to FIGS. 4, 5, and 6.

The punch assembly illustrated in FIG. 4 is of standard construction. It consists of a punch pad 50 to which a particular configuration of punch, shown here in dotted lines, is generally welded. The punch pad 50 fits into a punch retaining ring 52, the proper setting of which is determined by the slot 51 in the pad 50 and key 53 in the retaining ring 52. When interfitted, these are secured to the top plate 15 of the die set. For the sake of simplicity, the mounting holes are shown in the pad 50 and in the retaining ring 52. These correspond, respectively, with the threaded holes in the top plate 15. The shank 55 of the top plate 15 of the die set is for the purpose of clamping to the ram of the press.

Referring to FIG. 5, the die set is depicted with the die holder of the invention properly placed for the stamping operation. It is seen that the die block 12 rests on the bottom plate 13 of the die set. As mentioned before, the fastening means of the die block 12 to the plate 13 is not shown.

The frame member 10 is supported by the die block 12 and the stripper plate 22 is in place above the die plate 32. Overlying the latter is the workpiece 54 being fed by any conventional means.

The stamping operation is as follows. When the ram of the punch press hits the top plate 15 of the die set, the punch 56 passes through the opening of the stripper plate 22 and forces the work piece 54 into the opening of the die plate 32, thereby producing a part blank. It should be noted that, during this operation, the support plate 18 underlies the die plate 32. By virtue of this arrangement, the support of the die plate 32 does not rely solely on the pads 34 and 35 (FIGS. 2 and 3) but also on the plate 18.

After the part blank is punched out of the workpiece 54, the plate 18 is retracted, allowing the part blank to fall onto the surface of the die block 12. As the support plate 18 is again moved back into support position it pushes the part blank out of the die holder over the slanting surface 38 (illustrated in FIG. 3) and the die set is ready for the ensuing operation.

FIG. 6 is a side elevational view of the die set assembly shown in FIG. 5, the components thereof bearing identical reference characters to denote corresponding parts.

In this view, it is seen that the workpiece 54, passing over the die plate, is guided by pins 57 and 58 which are held in by the stripper plate 22. These pins are, of course, displaceable in order to accommodate the width of the workpiece used. This is standard procedure in this type of apparatus and is shown merely to complete the illustration. It is seen that the sliding support plate 18 is attached to an actuating rod 20 by means of coupling 59. By way of example, a bolt 60 is shown for this purpose. There are several ways to assure sliding movement of the support plate 18. For example, in FIG. 1 a piston 21 indicates that an air cylinder may be employed.

The invention herein shown and described is directed to a die holder which, in combination with a die set, has various novel and utilitarian features. By virtue of the above described sectional construction, the die block 12 can be made of low cost, cold rolled steel instead of the more expensive high carbon steel. Since the frame member 10 takes the maximum force exerted on the die, it must be of higher carbon steel, hardened for maximum strength. However, it is made thinner by virtue of the sectional construction and this reduces the cost.

This invention in its broader aspects is not limited to the specific embodiment herein shown and described but changes may be made within the scope of the accompanying claims without departing from the principles of the invention and without sacrificing its chief advantages.

What is claimed is:

1. In combination with a die set having a top plate with a punch secured thereto and a bottom plate, a die holder assembly adapted to be placed on said bottom plate, said die holder assembly comprising:

a die block;

a die retainer frame, said frame having spaced outer portions of a first thickness with connecting webs of a second reduced thickness extending between said outer portions, said outer portions and said webs defining an opening in said frame, walls of at least a portion of said opening being of a third thickness less than said first and second thicknesses;

a thin die plate positioned in said opening, said die plate being of said third thickness;

a sliding support member reciprocable between said die plate and said die block;

support pads for supporting said die plate on said die block, said support pads supporting said die plate above said die block at a height substantially equal to the thickness of said sliding support member; and, a stripper plate above said die, said stripper plate and said frame being secured to said block.

2. A die set in accordance with claim 1, wherein said support pads for said die comprise inserts of segmental configuration, removably secured to said die block.

3. A die set in accordance with claim 1, wherein said retainer frame comprises a solid block having a channel in said frame for slideably accepting said support member.

* * * * *